US005820175A

United States Patent [19]

Clavin

[11] Patent Number: 5,820,175

[45] Date of Patent: Oct. 13, 1998

[54] SELF-CLOSING LATCH

[75] Inventor: Timothy J. Clavin, Corona, Calif.

[73] Assignee: Hartwell Corporation, Placentia, Calif.

[21] Appl. No.: 717,838

[22] Filed: Sep. 23, 1996

[51] Int. Cl.[6] ..... E05C 1/12

[52] U.S. Cl. ..... 292/165; 292/170; 292/153; 292/DIG. 31

[58] Field of Search ..... 292/336.3, 165, 292/DIG. 31, 170, 169, 169.14, 153; 70/208

[56] References Cited

U.S. PATENT DOCUMENTS

| | | | |
|---|---|---|---|
| D. 303,922 | 10/1989 | Russell et al. . | |
| 2,900,204 | 8/1959 | Pelcin . | |
| 3,017,760 | 1/1962 | Jones . | |
| 3,495,862 | 2/1970 | McClintock . | |
| 3,698,215 | 10/1972 | Truhon . | |
| 3,707,862 | 1/1973 | Pastva, Jr. . | |
| 4,335,595 | 6/1982 | Swan et al. . | |
| 4,676,081 | 6/1987 | Craig . | |
| 4,683,736 | 8/1987 | Weinerman et al. . | |
| 4,841,755 | 6/1989 | Weinerman et al. . | |
| 4,882,919 | 11/1989 | Craig . | |
| 4,892,338 | 1/1990 | Weinerman et al. . | |
| 4,951,486 | 8/1990 | Braun et al. | 292/DIG. 31 X |
| 5,058,937 | 10/1991 | Miehe et al. | 292/DIG. 31 X |
| 5,413,391 | 5/1995 | Clavin et al. . | |

OTHER PUBLICATIONS

Actron catalog, entitled Locks, Latches, Slides and Bolting Systems, undated, cover and 3 pages.

Southco Inc., Assembly and Design Fasteners All kinds . . . from industry's broadest line, 1978, 1 sht.

RV News magazine, Lock It Up!, Sep. 1989, p. 34.

New Equipment Reporter, The Right Lock and Hinge at the Right Time and Price, undated, p. 11.

McMaster–Carr supply company catalog, Latches, undated, cover and p. 870.

*Primary Examiner*—Rodney M. Lindsey

*Attorney, Agent, or Firm*—Pretty, Schroeder & Poplawski

[57] ABSTRACT

A latch having a housing, a bolt sliding in the housing along a first axis, a handle pivoting in the housing along a second axis parallel to the first axis between a handle latched position and a handle unlatching position, a drive mechanism for driving the bolt by the handle between a bolt latched position and a bolt unlatching position, a first spring for urging the handle to the handle latched position and a second spring for urging the bolt to the bolt latched position, a cam plate sliding in the housing along a third axis perpendicular to the first and second axes, a first drive carried by the handle for translating the cam plate along the third axis, and a drive link mounted in the housing for pivoting about a fourth axis perpendicular to the first, second and third axes, the drive link including a drive pin for engagement by the cam plate in driving relation and for engaging the bolt along the cam surface of the bolt in driving relation.

13 Claims, 5 Drawing Sheets

FIG. 1
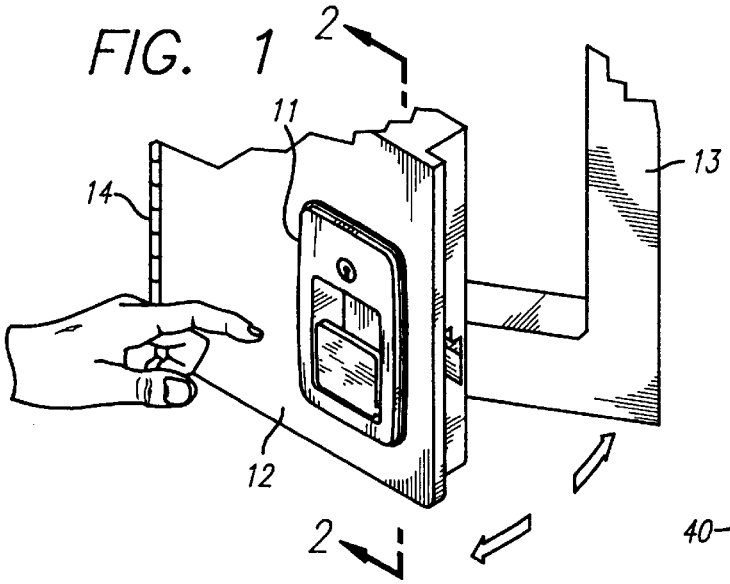
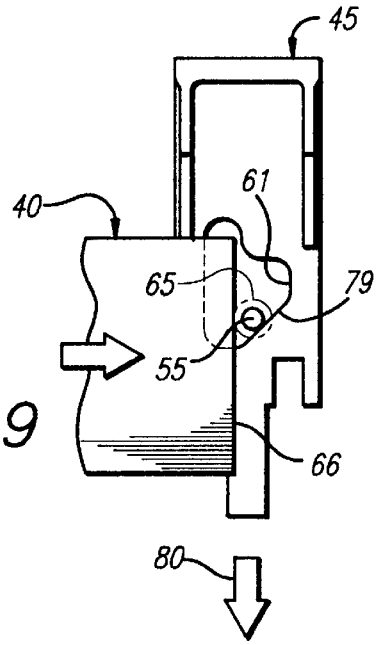
FIG. 9
FIG. 5
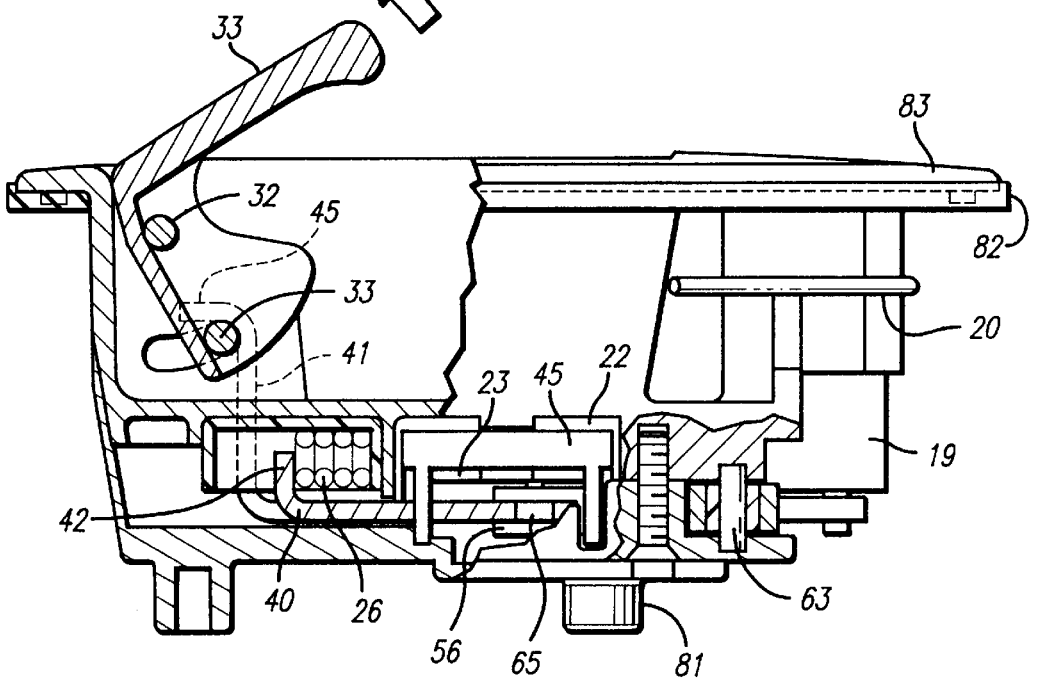

12
3
82
79
83
20
19
81
80
22
56
45
65
66
23
27
26
31
40
35
32
45
84
33
41
42
3

FIG. 6
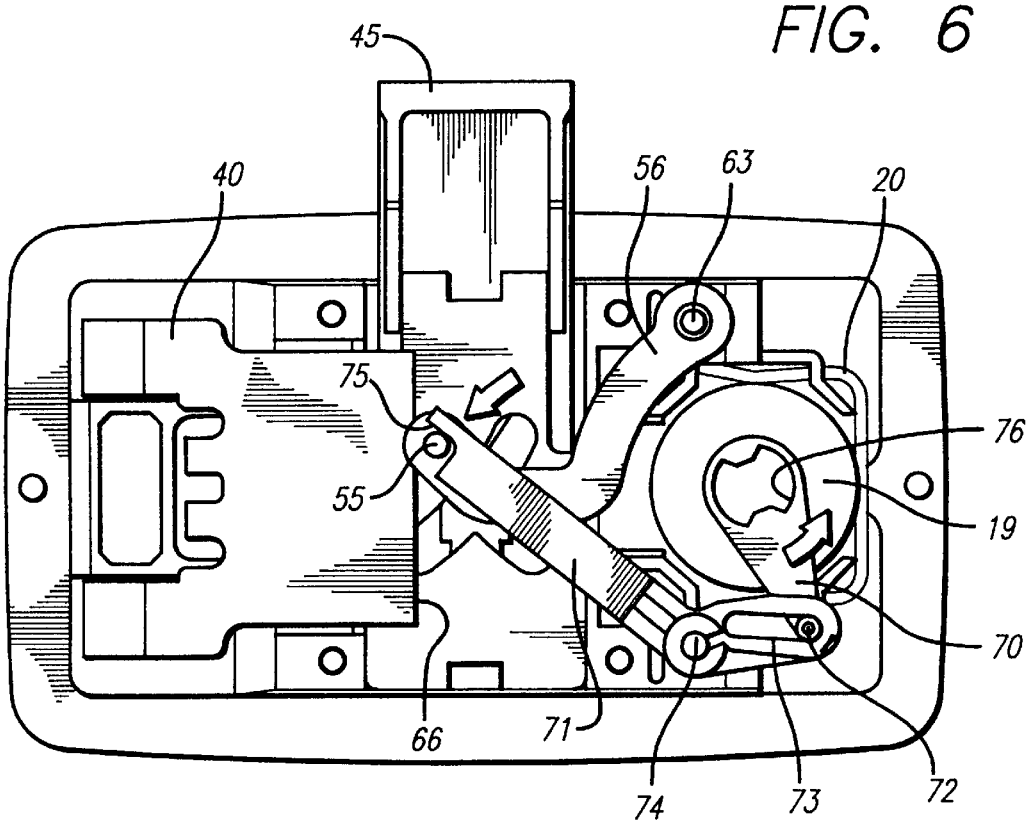
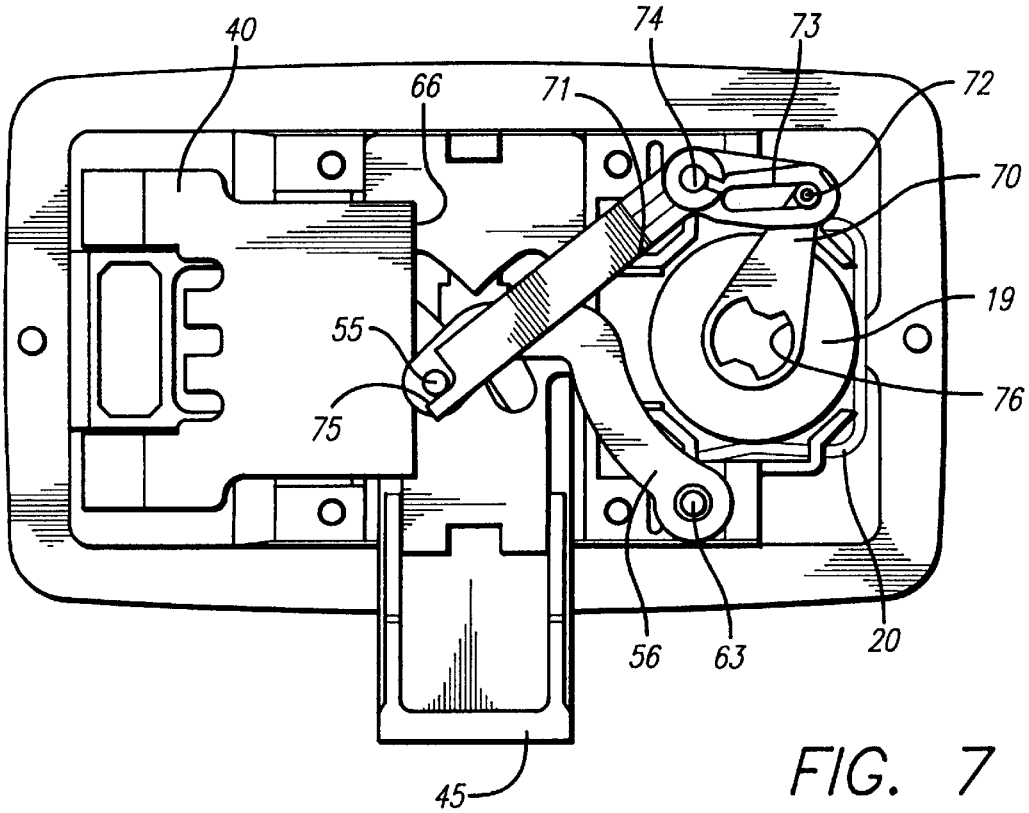
FIG. 7

SELF-CLOSING LATCH

BACKGROUND OF THE INVENTION

This invention relates to self-closing latches of the type shown in U.S. Pat. No. 5,413,391. Latches of this type are operated by pulling a paddle handle which causes a latching bolt positioned parallel to the handle axis to slide inward towards the body of the latch. Latches of this type often are spring loaded to maintain the bolt in the latched position, while permitting self-closing when the door carrying the latch is shut. One of the problems sometimes encountered with prior art latches is the limitation on bolt travel which in turn places limits on the tolerances in construction of the door frame and of the door being latched to the frame.

By way of example in a typical latch constructed according to said U.S. Pat. No. 5,413,391 the bolt travel is about 0.35 inches. This maximum travel places a specific limitation on the construction of the frame and door for which the latch is to be used. In contrast, with a latch of the same size and constructed pursuant to the present invention, the bolt travel is about 0.6 inches.

Accordingly, it is an object of the present invention to provide a new and improved self-closing latch which overcomes these disadvantages.

Other objects, advantages, features and results will more fully appear in the course of the following description.

SUMMARY OF THE INVENTION

In a latch having a housing, a bolt sliding in the housing along a first axis, a handle pivoting in the housing along a second axis parallel to the first axis between a handle latched position and a handle unlatching position, a drive mechanism for driving the bolt by the handle between a bolt latched position and a bolt unlatching position, first spring means for urging the handle to the handle latched position, and second spring means for urging the bolt to the bolt latched position, the improvement including a cam plate sliding in the housing along a third axis perpendicular to the first and second axes, first drive means carried by the handle for translating the cam plate along the third axis as the handle is pivoted about the first axis to the handle unlatching position, the bolt having a cam opening, and a drive link mounted in the housing for pivoting about a fourth axis perpendicular to the first, second and third axes, the drive link including drive pin means for engagement by the cam plate in driving relation and for engaging the bolt along the cam surface in driving relation. Preferably the cam opening has a first surface substantially parallel to the third axis and a second surface oblique to the third axis for engagement with the drive pin means, with initial translation of the cam plate moving the drive pin means along the first surface and with further translation of the cam plate moving the drive pin means along the second surface translating the bolt.

In the preferred embodiment, the cam plate has a free end, and the drive pin means includes a pin carried in the drive link and extending along a fifth axis parallel to the fourth axis and in engagement with the cam plate free end and with the bolt cam surface. Preferably a bushing is rotatingly carried on the drive pin for engagement with the cam plate free end.

In the preferred embodiment, the cam plate may also have disposed in a plane parallel to the plane of the first and third axes, a first pair of legs perpendicular to the base and engageable by the handle to translate the plate toward the unlatched position, and a second pair of legs perpendicular to the base and engageable by the first spring means for urging the plate toward the latched position.

Also the housing may include means defining a cavity for receiving a lock having a rotating lock member, a lock crank for attachment to the rotating lock member for rotation by actuation of the lock between unlocking and locking positions, and a lock link mounted in the housing for rotation about a lock axis parallel to the fourth axis, with the lock link and lock crank having interengaging means for rotating the lock link by the lock crank, the lock link having an extension member for engaging the drive link and preventing rotation of the drive link when the lock is in the locking position.

BRIEF DESCRIPTION OF THE DRAWINGS

FIG. 1 is a perspective view illustrating the installation of the latch on a door;

FIG. 5 is a reduced view similar to that of FIG. 2 showing the latch in the unlatched position;

FIG. 6 is a view similar to that of FIG. 3 showing the latch in the latched and locked position;

FIG. 7 is a view similar to that of FIG. 6 showing the bolt installed for travel in a direction opposite to that of FIG. 6;

FIG. 9 is a partial view similar to that of FIG. 3 illustrating the unlatching operation.

DESCRIPTION OF THE PREFERRED EMBODIMENT

Figure 2:
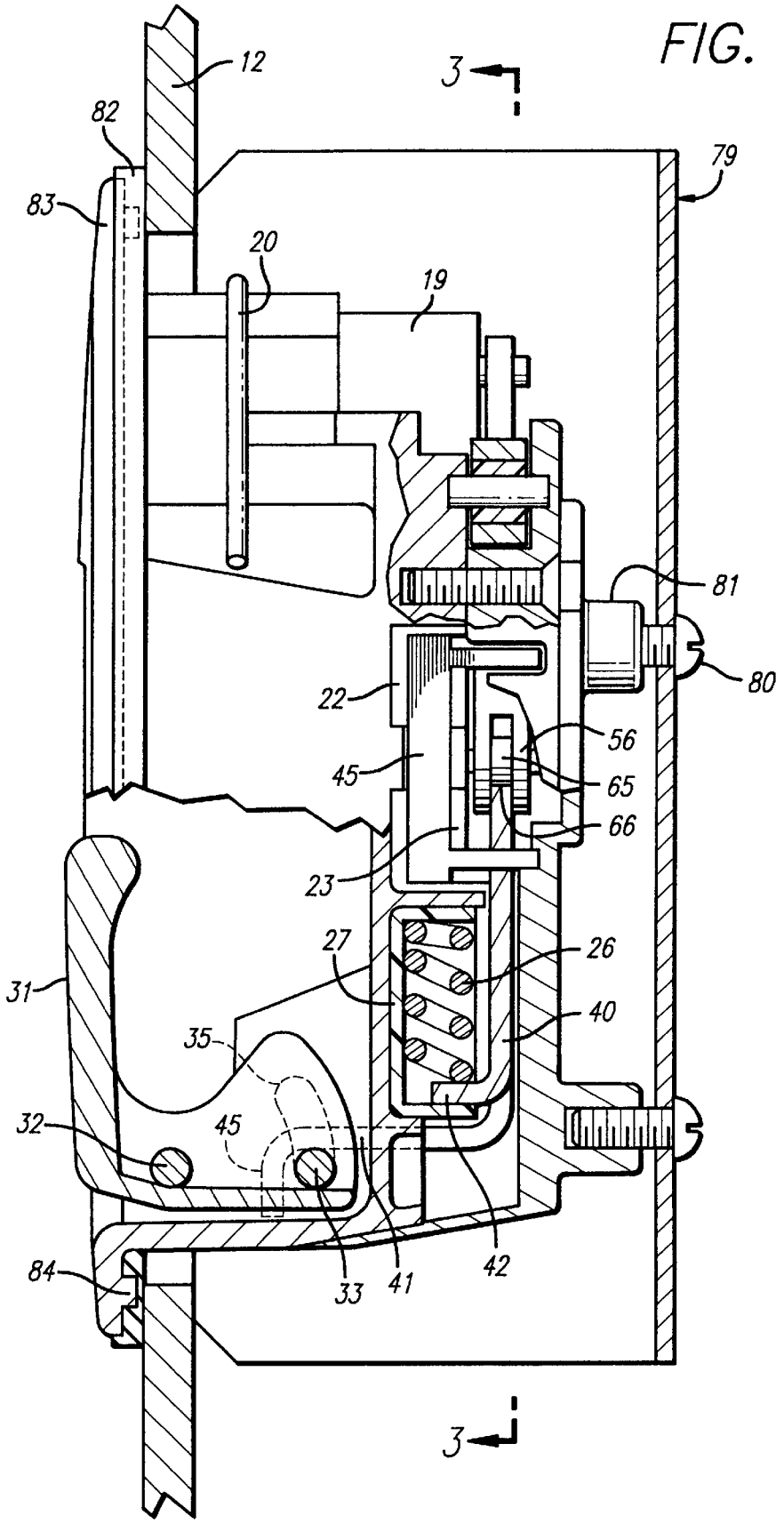
FIG. 2 is an enlarged sectional view taken along the line 2—2 of FIG. 1.

FIG. 1 illustrates a typical installation of the latch 11 in a door 12 mounted on a door frame 13 by a hinge 14.

The various components of the latch are carried in a housing 15 which is closed by a back plate 16 held in place by screws 17. The housing 15 includes a generally cylindrical opening 18 for receiving a lock mechanism 19 which may be attached by a retainer clip 20. The housing and back plate typically are metal die castings or plastic injection moldings. A bolt guide comprising a bolt guide top 22 and a bolt guide bottom 23 is carried in a key way 25 in the housing. Cam return springs 26 are positioned in a case 27 in an opening 28 in the housing. See FIGS. 2 and 8.

A handle 31 is pivotally mounted in the housing on a pivot pin 32. A drive pin 33 is carried in an extension 34 of the handle 31 and rides in radial slots 35 in the housing. Gaskets 36 are carried in the extension 34 of the handle around the drive pin 33 for limiting moisture entry into the interior of the latch. A grease pocket 37 may be provided in each gasket for improved water penetration resistance and lubrication.

A cam plate 40 slides in the housing. The cam plate has a first pair of legs 41 which are engaged by the drive pin 33 to move the cam plate from the latched position of FIGS. 2 and 3 to the unlatched position of FIGS. 4 and 5 when the handle 31 is raised. The cam plate also includes a second pair of legs 42 which project into the spring case 27 and are engaged by the springs 26 to urge the cam plate and handle to the latched position of FIGS. 2 and 3.

A bolt 45 slides in the bolt guide between the top 22 and bottom 23. The bolt guide top 22 has two notches 46, for wear pads 46*a* that protrude from the housing, two rectangular keys 47 that fit in mating slots 47*a* in the housing to keep the guides centrally and positively located, two perpendicular walls 48 that act as bearing services between housing walls and contain the bolt from lateral movement, and two walls 49 that act as supports for the bolt return springs 50. The bottom bolt guide 23 is similarly constructed with notches 51, keys 52, a cross path 53 and walls 54. The cross path 53 provides clearance for a drive pin 55 carried by a drive link 56, which will be described in detail hereinbelow.

Figure 8:
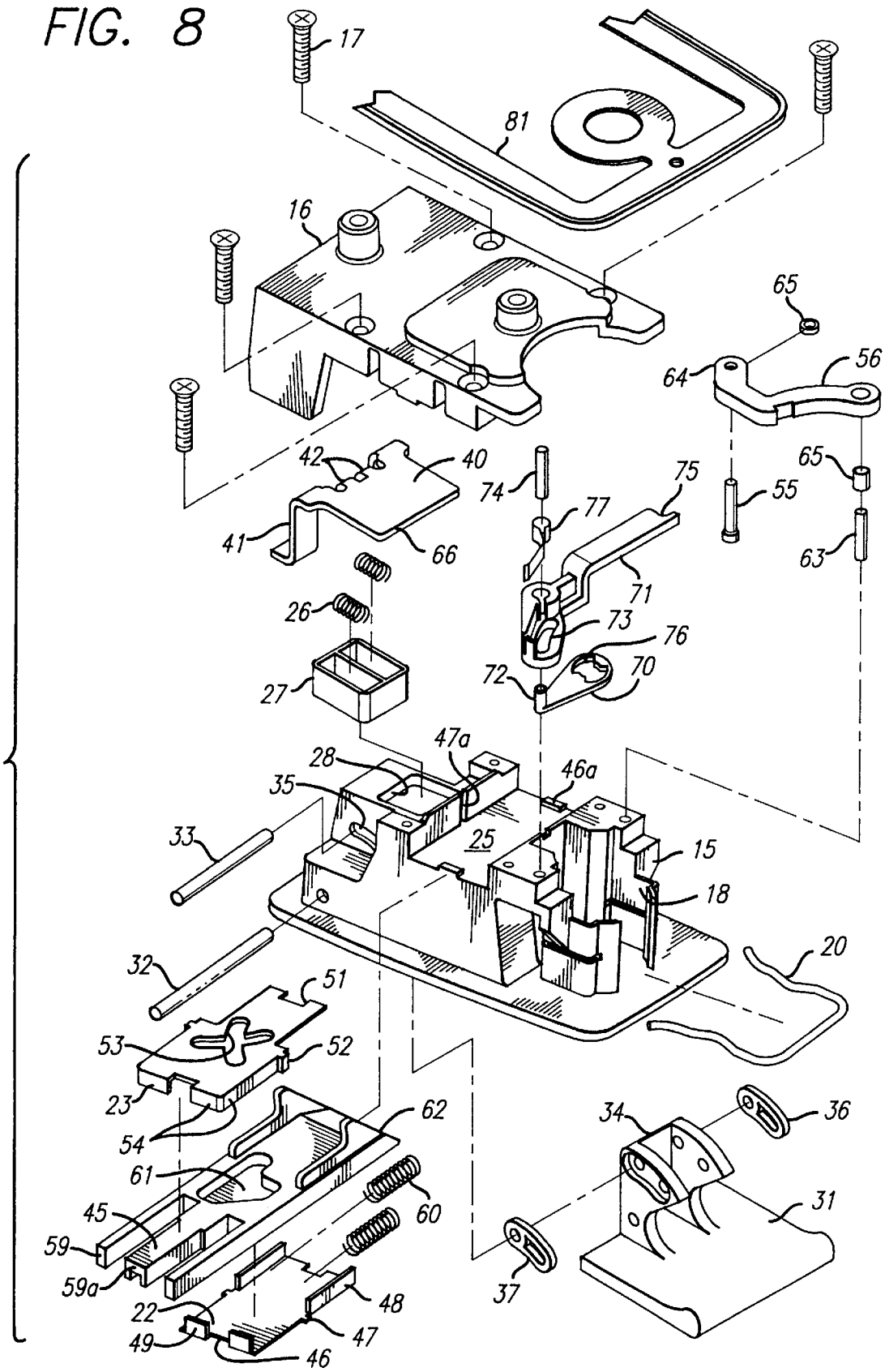
FIG. 8 is an exploded view of the latch.

The bolt 45 includes two fins 59 located at corners opposite the latching end to maintain alignment of springs 60 and opposed shoulders on the central tail 59*a* which also act as mechanical stops against the bolt guide. The bolt also has a recess cam opening 61 for engagement by the drive pin 55 to provide bolt motion during rotation of the drive link. The cam opening as shown in FIG. 8 is for a right-hand assembly. The cam opening will have the opposite configuration for a left-hand assembly. The leading edge 62 of the bolt has a ramp or a radius for easing the closing force. A groove (not shown) may be provided in the opposite face of the tail for receiving a lanyard for manual operation of the bolt, with an anchor boss or other means in the groove for attaching the lanyard.

The drive link 56 is mounted in the housing on a pivot pin 63 and bushing 65. The drive pin 55, typically a solid pin, is carried in the opposite end of the drive link. Preferably this opposite end has a slot 64 with a bushing 65 in the slot around the drive pin 55. In operation, the end 66 of cam plate 40 rides in the slot 64 against the bushing 65.

When the latch is used with the lock 19, a lock crank 70 is fitted to the lock 19 and has an inner end with an opening 76 for attachment to the lock and an outer end with a stud 72 riding in a slot 73 of a lock link 71. The lock link pivots on a pin 74 carried in the housing.

Figure 3:
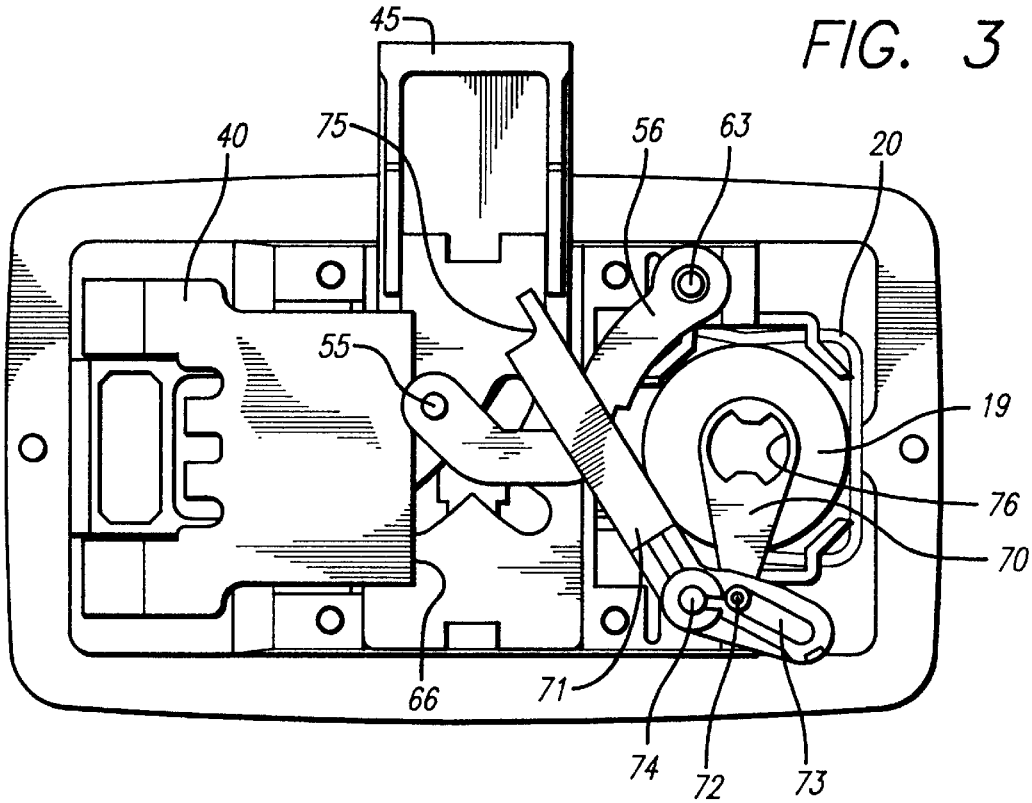
FIG. 3 is a reduced sectional view taken along the line 3—3 of FIG. 2 showing the latch in the latched and unlocked position.

The lock is shown in the unlocked position in FIG. 3. When the lock is rotated to the locked position of FIG. 6, the outer end 75 of the lock link 71 is rotated to engage the drive pin 55 of the drive link and prevent rotation of the drive link. This in turn prevents translation of the bolt.

A detent spring 77 is carried on the pin 74 and functions to maintain the lock link and lock crank in either the locked or the unlocked position. The circular portion of the detent spring rides on the pin and functions as a bushing between the pin and the lock link, with the two flat sections of the spring at an angle to one another maintaining the lock crank in either the locked or unlocked position.

The latch may be installed by a mounting bracket 79 which is generally U-shaped and fits around the latch from the bottom, typically being held in place by screws 80 engaging mounting bosses 81 of the back plate. Typically a moisture sealing gasket 82 is positioned between the flange 83 of the housing and the door 12. The gasket may have openings at each end to receiving locating bosses 84 of the flange. See FIG. 2.

Figure 4:
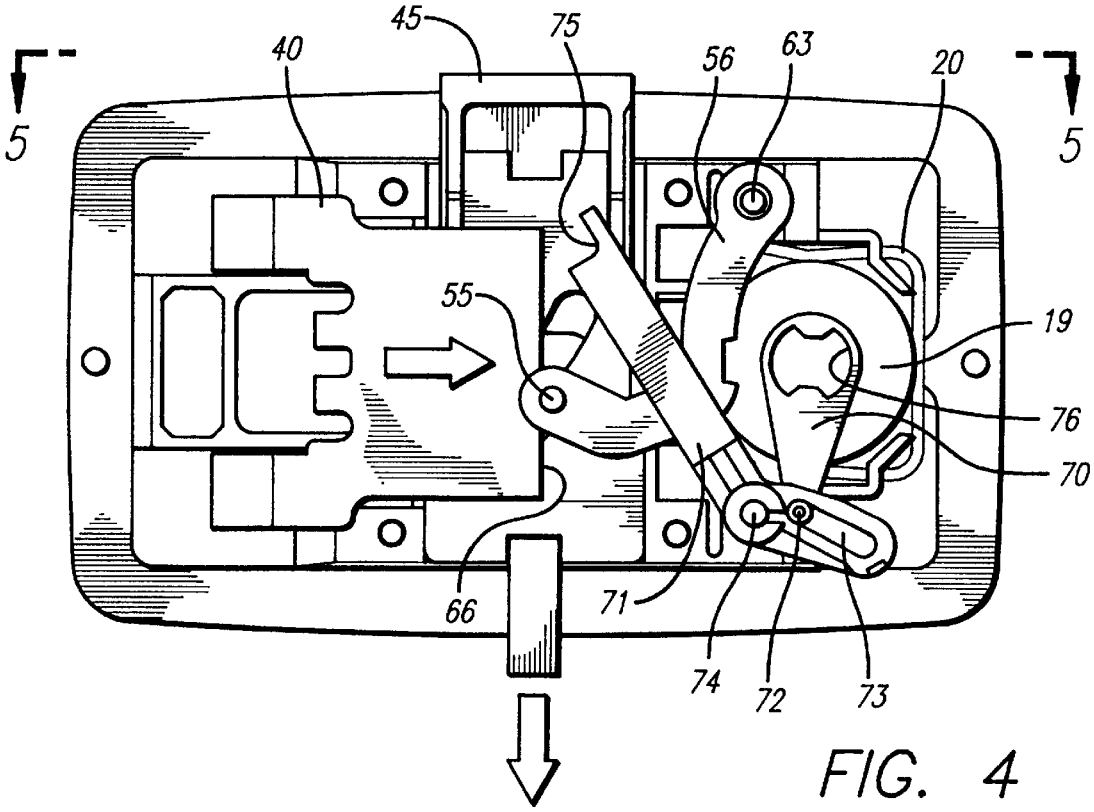
FIG. 4 is a view similar to that of FIG. 3 showing the latch in the unlatched position.

In operation, the handle 31 is lifted from the position of FIG. 2 to the position of FIG. 5, pivoting on the pivot pin 32. This rotation of the handle moves the drive pin 33 in the slots 35, engaging the legs 41 of the cam plate 40 and translating the cam plate from the position of FIG. 2 to the position of FIG. 5, compressing the springs 26. Translation of the cam plate brings the edge 66 of the plate into engagement with the bushing on the drive pin 55 and rotates the drive link 56, as shown in FIGS. 9 and 4. The bushing 65 of the drive link rotates during this operation, reducing the wear and friction. As the handle rotates, the drive pin moves along a ramp or oblique portion 79 of the cam opening, thereby causing the bolt to translate in the direction of the arrow 80, moving the bolt into the housing from the position of FIG. 3 to the position of FIG. 4, thereby unlatching the latch.

When the handle is released, the springs 26 return the handle to the latched position of FIGS. 2 and 3 and the bolt springs 60 return the bolt to the position of FIGS. 2 and 3. If the door is open, the door can be latched by closing the door, with the bolt moving to the unlatched position by engagement of the bolt ramp with the strike of the door frame.

The novel construction with the translating cam plate which rotates the drive link which in turn translates the bolt by engagement with the drive pin and cam surface permits achieving an increased bolt travel for the same size overall package. By way of example, the product shown in the earlier patent has a bolt travel of 0.35 inches, while the product of the present invention having the same overall dimensions has a bolt travel of 0.6 inches. At the same time as with the earlier design, the latch can be constructed with a right-hand bolt or with a left-hand bolt as desired. The cam surface in the bolt and the lock link will be different for the right-hand and left-hand installations.

Other advantages of this design include: improved resistance to moisture penetration with the grease carrying gaskets on the handle; reduced friction and wear due to rolling contract provided by bushings on the pins; minimal required handle rotation of 30 degrees reduces likelihood of finger slippage while opening door; and optional remote operation with lanyard.

I claim:

1. In a latch having a housing, a bolt sliding in said housing along a first axis, a handle pivoting in said housing about a second axis parallel to said first axis between a handle latched position and a handle unlatching position, a drive mechanism for driving said bolt by said handle between a bolt latched position and a bolt unlatching position, first spring means for urging said handle to said handle latched position, and second spring means for urging said bolt to said bolt latched position, the improvement including:

a cam plate sliding in said housing along a third axis perpendicular to said first and second axes;

first drive means carried by said handle for translating said cam plate along said third axis as said handle is pivoted about said second axis to said handle unlatching position;

said bolt having a cam opening; and a drive link mounted in said housing for pivoting about a fourth axis perpendicular to said first, second and third axes, said drive link including drive pin means for engagement by said cam plate in driving relation and for engaging said bolt along said cam opening in driving relation.

2. A latch as defined in claim 1 wherein said cam plate includes:

a base;

a first pair of legs perpendicular to said base and engageable by said handle to translate said plate toward the handle unlatching position, and a second pair of legs perpendicular to said base and engageable by said first spring means for urging said plate toward said handle latched position.

3. In a latch having a housing, a bolt sliding in said housing about a first axis, a handle pivoting in said housing along a second axis parallel to said first axis between a handle latched position and a handle unlatching position, a drive mechanism for driving said bolt by said handle between a bolt latched position and a bolt unlatching position, first spring means for urging said handle to said handle latched position, and second spring means for urging said bolt to said bolt latched position, the improvement including:

a cam plate sliding in said housing along a third axis perpendicular to said first and second axes;

first drive means carried by said handle for translating said cam plate along said third axis as said handle is pivoted about said second axis to said handle unlatching position;

said bolt having a cam opening; and a drive link mounted in said housing for pivoting about a fourth axis perpendicular to said first, second and third axes, said drive link including drive pin means for engagement by said cam plate in driving relation and for engaging said bolt along said cam opening in driving relation;

wherein said cam opening has a first surface substantially parallel to said third axis and a second surface oblique to said third axis for engagement with said drive pin means, with initial translation of said cam plate moving said drive pin means along said first surface and with further translation of said cam plate moving said drive pin means along said second surface translating said bolt.

4. A latch as defined in claim 3 wherein said cam plate has a free end, and said drive pin means includes:

a pin carried in said drive link and extending along a fifth axis parallel to said fourth axis and in engagement with said cam opening; and a bushing rotating on said drive pin for engagement with said cam plate free end.

5. In a latch having a housing, a bolt sliding in said housing along a first axis, a handle pivoting in said housing about a second axis parallel to said first axis between a handle latched position and a handle unlatching position, a drive mechanism for driving said bolt by said handle between a bolt latched position and a bolt unlatching position, first spring means for urging said handle to said handle latched position, and second spring means for urging said bolt to said bolt latched position, the improvement including:

a cam plate sliding in said housing along a third axis perpendicular to said first and second axes;

first drive means carried by said handle for translating said cam plate along said third axis as said handle is pivoted about said second axis to said handle unlatching position;

said bolt having a cam opening; and a drive link mounted in said housing for pivoting about a fourth axis perpendicular to said first, second and third axes, said drive link including drive pin means for engagement by said cam plate in driving relation and for engaging said bolt along said cam opening in driving relation;

said cam plate having a free end, and said drive pin means including a pin carried in said drive link and extending along a fifth axis parallel to said fourth axis and in engagement with said cam plate free end and with said cam opening;

said cam plate having a base, a first pair of legs perpendicular to said base and engageable by said handle to translate said plate toward the handle unlatching position, and a second pair of legs perpendicular to said base and engageable by said first spring means for urging said plate toward said handle latched position.

6. A latch as defined in claim 5 wherein said housing includes means defining a cavity for receiving a lock having a rotating lock member, and including a lock crank for attachment to said rotating lock member for rotation by actuation of said lock between unlocking and locking positions, and a lock link mounted in said housing for rotation about a lock axis parallel to said fourth axis, said lock link and lock crank having interengaging means for rotating said lock link by said lock crank, said lock link having an extension member for engaging said drive link and preventing rotation of said drive link when said lock is in said locking position.

7. In a latch having a housing, a bolt sliding in said housing about a first axis, a handle pivoting in said housing along a second axis parallel to said first axis between a handle latched position and a handle unlatching position, a drive mechanism for driving said bolt by said handle between a bolt latched position and a bolt unlatching position, first spring means for urging said handle to said handle latched position, and second spring means for urging said bolt to said bolt latched position, the improvement including:

a cam plate sliding in said housing along a third axis perpendicular to said first and second axes;

first drive means carried by said handle for translating said cam plate along said third axis as said handle is pivoted about said second axis to said handle unlatching position;

said bolt having a cam opening; and a drive link mounted in said housing for pivoting about a fourth axis perpendicular to said first, second and third axes, said drive link including drive pin means for engagement by said cam plate in driving relation and for engaging said bolt along said cam opening in driving relation;

wherein said cam plate has a free end, and said drive pin means includes, a pin carried in said drive link and extending along a fifth axis parallel to said fourth axis and in engagement with said cam opening, and a bushing rotating on said drive pin for engagement with said cam plate free end.

8. A latch as defined in claim 7 wherein said cam plate includes:

a base;

a first pair of legs perpendicular to said base and engageable by said handle to translate said plate toward the handle unlatching position, and a second pair of legs perpendicular to said base and engageable by said first spring means for urging said plate toward said handle latched position.

9. A latch as defined in claim 8 including a back plate attached to said housing, and top and bottom bolt guides carried in said latch between said housing and said back plate, with said top and bottom bolt guides defining a bolt slide space therebetween and with said second spring means positioned in said bolt slide space.

10. A latch as defined in claim 9 wherein said housing includes means defining a cavity for receiving a lock having a rotating lock member, and including a lock crank for attachment to said rotating lock member for rotation by actuation of said lock between an unlocking position and a locking position, and a lock link mounted in said housing for rotation about a lock axis parallel to said fourth axis, said lock link and lock crank having interengaging means for rotating said lock link by said lock crank, said lock link having an extension member for engaging said drive link and preventing rotation of said drive link when said lock is in said locking position.

11. A latch as defined in claim 10 including a detent spring carried by said lock link and having a first surface for maintaining said lock link in said locking position and a second surface for maintaining said lock link in said unlocking position.

12. In a latch having a housing, a bolt sliding in said housing about a first axis, a handle pivoting in said housing along a second axis parallel to said first axis between a handle latched position and a handle unlatching position, a drive mechanism for driving said bolt by said handle between a bolt latched position and a bolt unlatching position, first spring means for urging said handle to said handle latched position, and second spring means for urging said bolt to said bolt latched position, the improvement including:

a cam plate sliding in said housing along a third axis perpendicular to said first and second axes;

first drive means carried by said handle for translating said cam plate along said third axis as said handle is pivoted about said second axis to said handle unlatching position:

said bolt having a cam opening; and a drive link mounted in said housing for pivoting about a fourth axis perpendicular to said first, second and third axes, said drive link including drive pin means for engagement by said cam plate in driving relation and for engaging said bolt along said cam opening in driving relation;

wherein said housing includes means defining a cavity for receiving a lock having a rotating lock member, and the latch further including, a lock crank for attachment to said rotating lock member for rotation by actuation of said lock between an unlocking position and a locking position, and a lock link mounted in said housing for rotation about a lock axis parallel to said fourth axis, said lock link and lock crank having interengaging means for rotating said lock link by said lock crank, said lock link having an extension member for engaging said drive link and preventing rotation of said drive link when said lock is in said locking position.

13. A latch as defined in claim 12 including a detent spring carried by said lock link and having a first surface for maintaining said lock link in said locking position and a second surface for maintaining said lock link in said unlocking position.

* * * * *